United States Patent [19]

Bardonnet

[11] 4,195,445

[45] Apr. 1, 1980

[54] MACHINE FOR EDGING AND BEVELLING OPHTHALMIC LENSES

[75] Inventor: Pierre Bardonnet, Montgeron, France

[73] Assignee: Essilor International (Compagnie Generale d'Optique) Societe Anonyme, Creteil, France

[21] Appl. No.: 926,110

[22] Filed: Jul. 19, 1978

[30] Foreign Application Priority Data

Jul. 20, 1977 [FR] France ..... 77 22223

[51] Int. Cl.[2] ..... B24B 9/14

[52] U.S. Cl. ..... 51/101 LG

[58] Field of Search ..... 51/97 NC, 100 R, 101 LG, 51/216 LP, 284 E

[56] References Cited

U.S. PATENT DOCUMENTS

| | | | |
|---|---|---|---|
| 2,293,291 | 8/1942 | Gaspari | 51/101 LG |
| 3,063,340 | 11/1962 | Dillon | 51/284 E X |
| 3,513,598 | 5/1970 | Asselin et al. | 51/101 LG |
| 3,769,755 | 11/1973 | Kania et al. | 51/284 E X |
| 4,003,165 | 1/1977 | Saun | 51/101 LG |

FOREIGN PATENT DOCUMENTS 1261435 4/1961 France .

*Primary Examiner*—Gary L. Smith
*Assistant Examiner*—Robert P. Olszewski

[57] ABSTRACT

Machine for edging and bevelling ophthalmic lenses comprising guide means for forming a small bevel on the edge of lenses having a relatively thick edge, said guide means comprising a guide member connected to the frame of the machine by means of a pair of links forming a parallel-link motion device, a pair of springs constantly urging said links to a stable position in which their longitudinal axes form a predetermined angle with the axis of the rotating spindle which supports the lens to be bevelled, a bearing member supported by a movable carrier for said spindle and urged for engagement with said guide member, one of the guide member and bearing member comprising a bar extending at right angles to the spindle axis and provided with coupling means capable of preventing any relative movement between the guide member and the bearing member in a direction at right angles to the spindle axis. The adjustments of the machine for forming the small bevel art thus greatly simplified.

11 Claims, 8 Drawing Figures

MACHINE FOR EDGING AND BEVELLING OPHTHALMIC LENSES

FIELD OF THE INVENTION

The present invention relates in general to machines for edging and bevelling ophthalmic lenses, and has specific reference to a machine of the general character in which a templet and a lens to be edged in accordance with the templet shape or contour are supported by a spindle rotating at a low speed and having an axis of rotation parallel to a fixed direction, said spindle being rotatably mounted in a movable carrier operatively connected to a frame structure of the machine through coupling means allowing movements of said carrier both in a first direction parallel to said fixed direction and in a second direction perpendicular to said first direction, a feeler carried by the frame structure cooperating with said templet to limit the penetration of a grinding wheel rotating at a high speed and carried by the frame structure into the edge of the lens, and in which guide means are provided for guiding the movements of said movable carrier in accordance with a predetermined curvature, said guide means comprising a guide member carried by said frame structure and a bearing member carried by said movable carrier and urged for engagement with the guide member, one of said guide member and bearing member being adjustable in said first direction.

BACKGROUND OF THE INVENTION

It is known that when an ophthalmic lens has been edged to the shape of a templet corresponding to a spectacles frame choosen by the patient, it is subsequently necessary to form a bevel or a groove in the edge of the edged, lens to permit the mounting and fitting thereof in the spectacles frame provided with suitable bevels or rims for this purpose. Although the term "bevel" is applicable more particularly to a relief portion, in the present specification and in the appended claims the word "bevel" will be used for designating a relief portion as well as a hollow portion.

Bevelling the edge of an edged lens is by no means difficult in the case of low-power lenses which in general have a relatively thin edge. In fact, in this case, the major bevel of the grinding wheel is utilized in general for this purpose, and the thin edge of the edged lens is engaged into the large V of the major bevel of the grinding wheel so that even if the lens has not a circular shape after it has been edged, as in common practice, the major bevel of the grinding wheel will guide automatically the lens during the rotation of the spindle carrying the lens and the templet.

On the other hand, in the case of thick, medium-power or high-power lenses or in the case of spherotoric lenses having a wider edge than low-power lenses, the small bevel of the grinding wheel is used as a rule. In this case guide means capable of guiding the movement of the movable spindle carrier so that the bevel being ground remains between the limits of the lens edge during the rotation of the spindle must be provided. According to their conception, hitherto known guide means take due account of the curvature of one of the lens faces, or the average curvature of the lens, or the spectacles frame curvature or a combination of these factors.

PRIOR ART

A first known type of guide means comprises a fixed bearing member engaged by one of the lens faces, the lens being resiliently urged against the bearing member (see for example the U.S. Pat. No. 2,293,291). With the guide means of this first type the bevel being formed follows the front or rear face of the lens engaging the bearing member. The bevel thus obtained has therefore the same curvature as the lens face having acted as a bearing surface, and this curvature does not always correspond to the curvature of the meniscus of the spectacles frame. Under these conditions, the curvature of the spectacles frame must be modified to permit the setting of the lens therein. Moreover, the frictional contacts thus created between the bearing member and the lens face engaging the bearing member are likely to scratch the delicate lens surface, notably in the case of synthetic or organic lenses.

A second known type of guide means comprises a connecting link having one end pivoted to the machine frame and the opposite end pivoted to the movable spindle carrier (see for example the French Pat. Nos. 1 312 689, 2 246 355 and 2 246 356). The guide device described and illustrated in the French Pat. No. 1 312 689 comprises two adjustment devices and the one disclosed in the French Pat. No. 2 246 356 constitutes a simplified version of the preceding device in that it comprises only one adjustment device. In both cases the average curvature of the lens (which does not compulsorily corresponds to the spectacles frame meniscus curvature) is duly taken into account, so that in some instances the spectacles frame curvature must be modified.

A third known type of guide means comprises a guide cam carried by the frame of the machine or the movable spindle carrier, and a bearing member or can follower which is carried by the movable spindle carrier or the machine frame, respectively, the movable spindle carrier being resiliently urged in the longitudinal direction of said spindle in order to press the bearing member and the guide cam against each other. The guide cam profile is so selected that the movements of the movable carrier in a direction at right angles to the spindle axis under control of the templet engaged by said feeler, will cause the spindle carrier to move in a direction parallel to the spindle axis, so that the bevel being formed be inscribed on the lens edge along a path remaining on a sphere of which the radius is determined as a function of the desired bevel curvature, with due consideration for the curvature of the lens and/or the spectacles frame (see for example the French Pat. Nos. 1 261 435 and 1 510 824). With guide means of this third type it is usually necessary to provide several different interchangeable cams and two adjustment devices. One of the two adjustment devices allows adjustment of the position of the bearing member or of the guide cam in a direction perpendicular to the spindle axis, so that the bearing member can "scan" a suitable portion of the guide cam profile. With the other adjustment device it is possible to adjust the position of the bearing member or of the guide cam in a direction parallel to the spindle axis in order to shift the bevel towards the front face or the rear face of the lens. Although the guide means of this third type are such that the bevel can be given any desired curvature, the operation of a machine thus constructed is extremely complicated. In fact, a first requirement is to select a guide cam having a suitable profile among a set of guide cams, and then two adjustments must be made. Since one of these adjustments counteracts the other adjustment, it is necessary to proceed by trial and error. Therefore, the preliminary adjustments of the machine for each lens to be bevelled are extremely tedious and time-robbing, and can only be accomplished by very skilled hands.

SUMMARY OF THE INVENTION

It is the main object of the present invention to avoid the above-mentioned drawbacks of the known guide means of the third type by providing a lens edging and bevelling machine of the general character set forth in the above preamble, which comprises a guide means akin to hitherto known third-type guide means inasmuch as it also comprises a bearing member and a guide member urged against each other, but requiring only one adjustment.

To this end, the invention provides a machine for edging and bevelling ophthalmic lenses, which is characterized in that the guide member is connected to the frame structure of the machine by means of a pair of parallel links of same length forming a parallel-motion coupling, in that a pair of antagonistic springs constantly urge the assembly consisting of said guide member and said pair of links to a stable position in which the longitudinal axes of said links form a predetermined angle with the axis of the spindle, and in that one of said guide member and bearing member comprises a bar extending parallel to the second direction and provided with coupling means capable of preventing any relative movement between the guide member and the bearing member in said second direction.

In order to afford a clearer understanding of the present invention, reference will now be made to the accompanying drawing:

DETAILED DESCRIPTION OF PREFERRED AMBODIMENTS OF THE INVENTION

Figures 1, 2, 5, 6, 7:
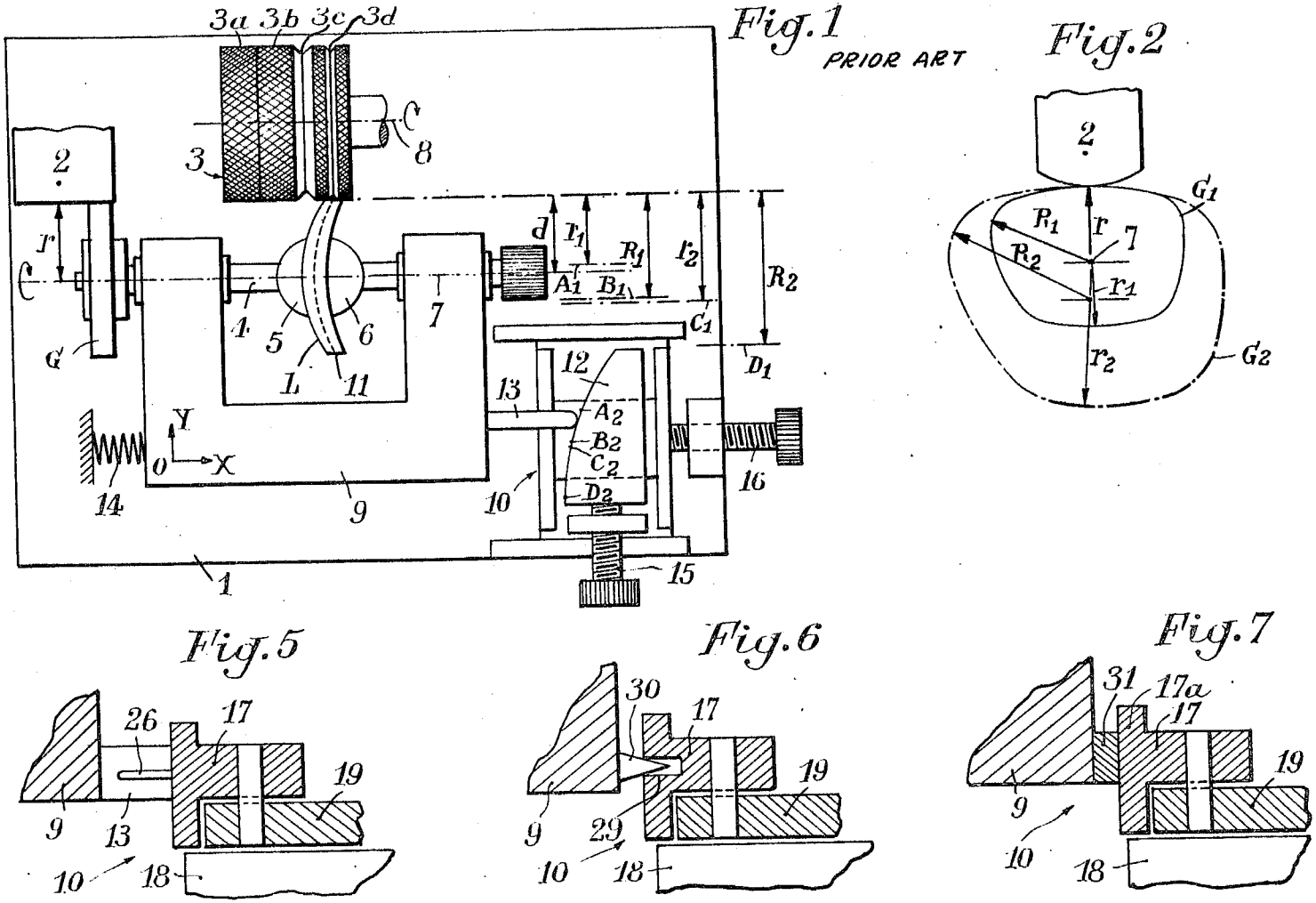
Fig. 1 PRIOR ART
FIG. 1 is a diagrammatic plane view from above showing a known lens edging and bevelling machine comprising cam-type guide means.
FIG. 2 shows two templets having different shapes and sizes, and is useful, in combination with FIG. 1, for explaining the necessity of providing two adjustment devices when cam-type guide means is used.
FIG. 5 is a section on a larger scale taken along line V—V of FIG. 3.
FIGS. 6 to 8 are views similar to FIG. 5 showing various modifications of the machine according to the invention.

The machine for edging and bevelling ophthalmic lenses, which is illustrated diagrammatically in FIG. 1, comprises essentially a frame 1 supporting a feeler 2 and a grinding wheel 3 rotatably driven at a high speed by a motor (not shown). The outer periphery of grinding wheel 3 comprises a plurality of working areas spaced along the axis of rotation of the grinding wheel, and comprising for example a roughing-out section 3*a*, a finishing section 3*b*, another section 3*c* comprising a wide V-shaped annular groove for forming a relatively large bevel on the lens edge, and a section 3*d* comprising a marrower V-shaped annular groove for forming a small bevel on the lens edge.

A templet G is fastened to one end of a spindle 4 and the ophthalmic lens L to be edged in accordance with the contour of the templet G is clamped between two jaws or holders 5 and 6 carried by the spindle 4. The spindle 4 is rotatably driven at a low speed either manually or from a motor (not shown). The axis of rotation 7 of the spindle 4 is parallel to the axis of rotation 8 of the grinding wheel 3. The spindle 4 is rotatably mounted in a movable, C-shaped carrier 9, also called a carriage or rocker, connected to the frame 1 through coupling means permitting movements of said carrier 9 in a direction OX parallel to the axes 7 and 8, and in another direction OY perpendicular to said axes 7 and 8. For this purpose, various types of couplings may be contemplated, such as for instance a crossed-slide system similar to that disclosed in the French Pat. No. 1 312 689, or a pair of links similar to those described in the French Pat. No. 2 246 355, or alternatively a shaft parallel to axis 7 and rigid with the frame, with said carrier 9 adapted to pivot and slide in relation to said shaft as disclosed in the French Pat. Nos. 1 261 435 (FIG. 9) and 1 510 824 and in the U.S. Pat. No. 2 293 291. The lens L may be urged against the grinding wheel 3 by a spring or a counter-weight (not shown) acting on said carrier 9. At the end of each roughing-out, finishing or bevelling operation and prior to the next operation, the carrier 9 may be moved away from the grinding wheel 3 and then in the direction OX and eventually again towards the grinding wheel 3 either manually or automatically with the assistance of a known transfer device, for example of the cam type. The machine illustrated in FIG. 1 further comprises guide means 10 capable of guiding the movements of the carriage 9 when the section 3*d* of grinding wheel 3 is utilized, in such a manner that the small bevel formed on the edge 11 of the lens L remains within the limits of said edge when the spindle 4 is rotated. The guiding means 10 comprises a cam 12 carried by the frame 1 and a bearing member or cam follower 13 carried by the carrier 9 and urged for engagement with the cam 12 by a suitable member such as a spring 14 or a pneumatic actuator (not shown) acting on the carrier 9.

If the ophthalmic lens L has been edged in accordance with the profile of templet $G_1$ shown in FIG. 2, it will be seen that the distance d between the axis 7 of spindle 4 and the grinding wheel 3 will vary, during the rotation of spindle 4, as a function of the momentary value of the radius r of said templet $G_1$ at the point of contact thereof with the feeler 2. Therefore, the axis 7 of the spindle 4 will move between two positions $A_1$ and $B_1$ corresponding to the minimum radius $r_1$ and the maximum radius $R_1$ of templet $G_1$, respectively. During the same time, the bearing member 13 will scan or sweep the portion $A_2$ $B_2$ of the profile of cam 12. Similarly, if the ophthalmic lens has been edged in accordance with the profile of templet $G_2$ shown in dash and dot line in FIG. 2, during rotation of the spindle 4 the axis 7 thereof will move between positions $C_1$ and $D_1$ corresponding to the minimum radius $r_2$ and the maximum radius $R_2$ of templet $G_2$, respectively, and the bearing member 13 will scan the portion $C_2D_2$ of the profile of the cam 12. It will be seen that the portions $A_2B_2$ and $C_2D_2$ of the cam profile have different average slopes in relation to the axis 7. Consequently, the curvature of the bevel formed on the edge 11 of lens L will vary in accordance with the portion of the cam profile which is actually scanned by the bearing member 13. Since the various patterns of templets G have minimum and maximum dimensions likely to vary within relatively wide limits, it is necessary to provide a first adjustment device for causing the bearing member 13 to scan the proper portion of the profil of cam 12 so that the bevel having the desired curvature can be obtained. To this end, in known edging and bevelling machines it is possible to move either the bearing member 13 or the cam 12 in the direction OY at right angles to the axis 7 of spindle 4, for example cam 12 as shown in FIG. 1, by means of a first adjustment screw 15. However, it will be seen that a movement of cam 12 perpendicularly to the axis 7 is attended by a movement of carrier 9 and spindle 4 in the direction OX of the axis 7 of said spindle. It is therefore also necessary to provide a second adjustment device for positioning the edge 11 of lens L to a proper position in relation to the small bevel or annular groove 3*d* of the grinding wheel 3. To this end, in known bevelling machines, it is possible to move either the bearing member 13, or the cam 12 parallel to the axis 7 of spindle 4, for example the cam 12 as shown in FIG. 1, by means of a second adjustment screw 16. In actual practice, with a known edging and bevelling machine of the above-described type, when an ophthalmic lens has been edged in accordance with the profile of a selected templet, to adjust the machine with a view to grind a small bevel on the edge of the edged lens, the optician must apply the old trial and error method. More particularly, he makes a first adjustment by means of screws 15 and 16, and then rotates the spindle 4 manually to see whether the bevel will be properly formed along the lens edge within the limits thereof. Since it is quite exceptional that a proper adjustment be obtained from the onset, the adjustments must be repeated by turning the screws 15 and 16 each time, and this obviously constitutes a long and tedious operation.

This inconvenience is eliminated by the present invention which is based on the establishment of the following facts.

It is known that medium or high-power ophthalmic lenses have one face the curvature of which differs considerably from that of the opposite face. Therefore, the edge of the edged lens has a substantial width, both in the case of a negative-power concave lens or in the case of a positive-power, thin-edged convex lens to which the edging operation will rapidly impart an appreciable edge within. Modern spectacles frames have a meniscus of which the curvature has substantially the same value in all spectacles frames or varies only slightly from one model to another. Taking due account of the foregoing and also of the fact that medium or high power edged lenses have as a rule a substantial edge width, it becomes possible to guide the movements of the carrier 9 along a single circular path having a curvature corresponding to that of the meniscus of spectacles frames. However, a problem remains to be solved for obtaining this result, irrespective of the minimum or maximum dimensions of the templets.

Figure 3:
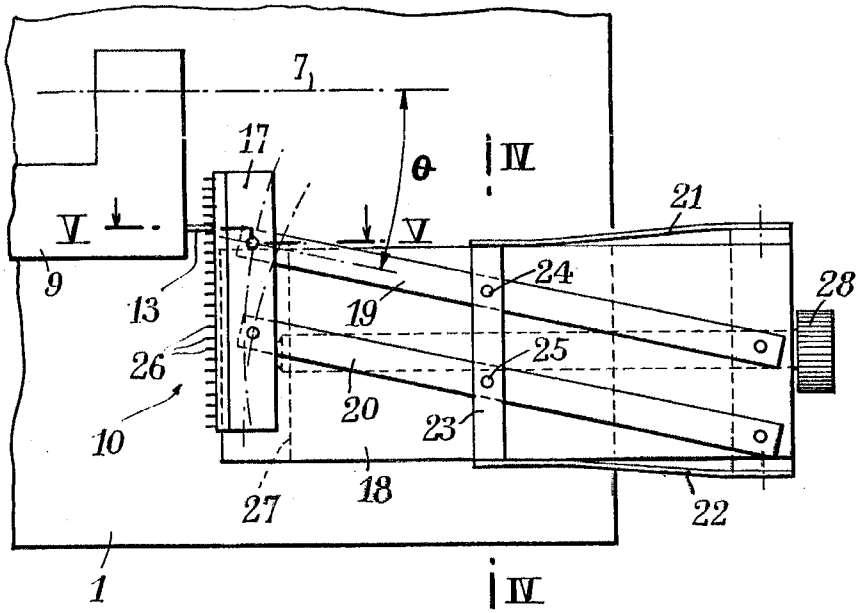
FIG. 3 is a diagrammatic plane view from above showing a portion of the machine illustrated in FIG. 1, but wherein guide means according to the present invention is substituted for the cam-type guide means.

According to the present invention, this problem is solved by using the guide means described hereunder with reference to FIG. 3. The edging and bevelling machine shown only diagrammatically and in fragmentary view in FIG. 3 may be identical with the machine shown in FIG. 1, except for the guide means 10 proper. In FIG. 3, the guide cam 12 of FIG. 1 is replaced by a small bar 17 extending at right angles to the axis 7 of spindle 4 and connected by means of a pair of parallel links 19, 20 of same length to a carriage 18, so as to constitute a parallel motion device. The length of the links 19 and 20, measured between their corresponding pivot points on bar 17 and carriage 18, is equal to an average value of the radii of curvature of the meniscus of the spectacles frames. The length of said links 19 and 20 may range from about 65 mm to about 85 mm, and is preferably 75 mm. A pair of spring blades 21 and 22 constantly urge the assembly comprising the bar 17 and the pair of links 19 and 20 to a stable, rest position in which the longitudinal axis of each link forms a predetermined angle $\theta$ with the axis 7 of spindle 4. Each one of the spring blades 21 and 22 has one end fastened to the carriage 18 and an opposite free end adapted to bear against a respective one of the end portions, bent at right angles, of a coupling bar 23 pivotally connected by means of pins 24 and 25 to the links 19 and 20, respectively. In order to keep the above-defined rest position independent of the forces of the spring blades 21 and 22, respectively, and in order to insure that said position will not vary as said spring blades loose their strength, the length of the coupling bar 23 is selected to be equal to the width of the carriage 18, and the free ends of the spring blades 21 and 22 also bear, in said rest position, against the opposite sides of the carriage 18 as illustrated in FIG. 4.

The bar 17 is provided with a plurality of regularly spaced pins 26 disposed along the entire length of bar 17 and extending parallel to the axis 7 of spindle 4. The bearing member 13 is in the form of a flat tongue, as shown in FIG. 5, which can be snugly engaged between any pair of adjacent pins 26. The pins 26 constitute a coupling means adapted to prevent any relative movement between the bearing member 13 and the bar 17 in a direction perpendicular to the axis 7.

Figure 4:
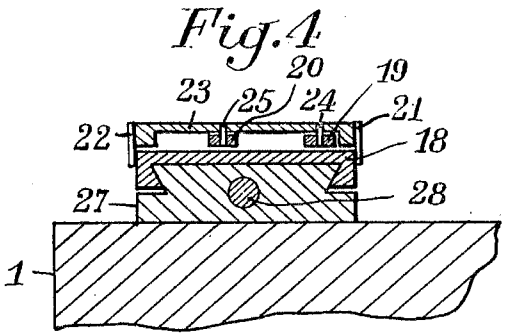
FIG. 4 is a section taken along line IV—IV of FIG. 3.

As shown more clearly in FIG. 4, the carriage 18 is mounted on a dovetail slideway 27 secured to the frame 1 and having its longitudinal axis parallel to the axis 7 of the spindle 4. The position of the carriage 18 may be adjusted by means of a screw 28 rotatably mounted, but held against axial movement, at the rear end of carriage 18, and engaging a tapped hole in said slideway 27.

The guide means 10 of FIG. 3 operates as follows. When the ophthalmic lens L has been edged in accordance with the contour of the selected templet G, and before the carrier 9 is moved to the right by the transfer device to bring the edge of the lens L in registration with the section 3*d* of the grinding wheel 3, the templet G is set in a predetermined angular position, for example the position corresponding to the minimum relative spacing between the axis 7 of spindle 4 and the grinding wheel 3 or feeler 2. This may be done for example by rotating the spindle 4 manually until the area of templet G having the smallest radius engages the feeler 2, or alternatively by providing a device for stopping the rotation of the spindle 4 automatically, when the edging operation is completed, in the position corresponding to the minimum distance d between the axis 7 and the grinding wheel 3. Then, the carrier 9 is moved to the right by the transfer device, until the bearing member 13 engages the bar 17, the latter being held in its stable rest position by the pair of spring blades 21 and 22. During this movement of the carrier 9, the tongue-shaped bearing member 13 fits between a pair of adjacent pins 26 of bar 17, thus providing a coupling between the carrier 9 and the bar 17. The position of the coupling point along the bar 17 depends of course on the dimensions of the templet G and more particularly on the value of its minimum radius r. When the coupling between the carrier 9 and the bar 17 corresponds to the minimum value of the templet radius r, the stable rest position of said bar 17 is determined by construction, so that the angle $\theta$ lies within the range of 10 to 20 degrees, and is preferably about 15 degrees. Under these conditions, it will be seen that, irrespective of the position of the coupling point along the bar 17, the latter will always follow the same path along a circular arc while remaining parallel to itself when the carrier 9 and the spindle 4 move towards and away from the grinding wheel 3 under the control of the templet G engaging the feeler 2, the radius of this circular arc being determined by the length of said links 19 and 20 corresponding to the average radius of curvature of the meniscus of the spectacles frames. Consequently, irrespective of the dimensions of said templet G, the carrier 9 will always be guided along the same circular arc path. Since, as already explained hereinabove, medium- and high-power ophthalmic lenses have a relatively wide edge, it is therefore only necessary to set the position of carriage 18 and thus the position of bar 17 by means of the adjustment screw 28 in order to position correctly the edge 11 of lens L in relation to the section 3*d* of the grinding wheel 3, so that the bevel will remain within the limits of the edge 11 of lens L when the spindle 4 is rotated, as can easily be checked by rotating the spindle 4 manually through one revolution.

From the above description it is clear that the setting of the machine for grinding a small bevel can be made both simply and rapidly by using only one adjustment device.

FIG. 6 illustrates a first modification of the guide means 10 and, more particularly, of the coupling means between the carrier 9 and bar 17. In this modified embodiment, the series of pins 26 of FIGS. 3 and 5 is replaced by a series of holes or notches 29 regularly spaced along the bar 17 and having their axes parallel to the spindle axis 7 (only one of these holes or notches 29 is visible in FIG. 6). In this case, the bearing member 13 of FIGS. 3 and 5 is replaced by a tapered element 30 adapted to engage anyone of the holes or notches 29.

FIG. 7 illustrates another modified embodiment, in which the coupling between the carrier 9 and the bar 17 is obtained through magnetic means. In this case, at least the portion 17*a* of the bar 17 may be made of a magnetizable material and the bearing member rigid with the carrier 9 may comprise a permanent magnet 31.

Figure 8:
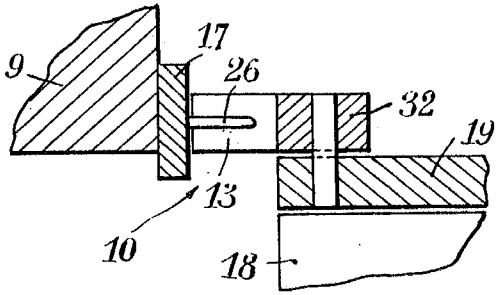

In the various embodiments illustrated in FIGS. 3 to 7, the bar 17 has mainly a guiding function. However, the respective positions of bar 17 and bearing member 13, 30 or 31 may be inverted, so that the bar 17 acts as a bearing member and the element 13, 30 or 31 acts as a guide member. For example, as illustrated in FIG. 8, the bar 17 provided with a series of pins 26 may be secured to the carrier 9, and the tongue 13 may be carried by a suitable support member 32 pivotally connected to the links 19 and 20.

According to another modified embodiment of the present invention, instead of providing an adjustment screw 28 and a carriage 18 movable in relation to the frame 1 for moving the bar 17 (FIGS. 3, 5, 6 and 7), or the member 13 (FIG. 8) in a direction parallel to the axis 7 of spindle 4 in order to set the position of the edge 11 of lens L in relation to the section 3*d* of the grinding wheel 3, it is also possible to provide an adjustment device (not shown) capable of moving the bearing member 13, 30 or 31 (FIGS. 3 5, 6 and 7) or the bar 17 (FIG. 8) in relation to the carrier 9 in a direction parallel to the axis 7. In this case, the links 19 and 20 may be pivotally connected directly to the frame 1.

What is claimed is:

1. In a machine for edging and bevelling ophthalmic lenses, in which a templet and a lens to be edged in accordance with the contour of said templet are supported by a spindle rotating at a low speed and having an axis of rotation parallel to a fixed direction, said spindle being rotatably mounted in a movable carrier operatively connected to a frame structure of the machine through coupling means allowing movements of said carrier both in a first direction parallel to said fixed direction and in a second direction perpendicular to said first direction, a feeler carried by the frame structure and cooperating with said templet to limit the penetration of a grinding wheel carried by the frame structure and rotating at a high speed into the edge of the lens, and in which guide means are provided for guiding the movements of said movable carrier in accordance with a predetermined curvature, said guide means comprising a guide member carried by said frame structure and a bearing member carried by said movable carrier urged for engagement with said guide member, one of said guide member and bearing member being adjustable in said first direction, the improvement comprising:

(a) the guide member is connected to the frame structure of the machine by means of a pair of parallel links of same length forming a parallel motion coupling, (b) a pair of antagonistic springs constantly urge the assembly consisting of said guide member and of said pair of links to a stable position in which the longitudinal axes of said links form a predetermined angle with the axis of said spindle;

(c) one of said guide member and bearing member comprises a bar extending parallel to said second direction, said bar having coupling means engageable with the other of said guide member and bearing member for preventing any relative movement between the guide member and the bearing member in said second direction.

2. Machine according to claim 1, wherein said predetermined angle is within the range of 10 to 20 degrees.

3. Machine according to claim 1, wherein the length of said links is within the range of 65 to 85 mm.

4. Machine according to claim 1, wherein the links have one end pivoted to a carriage of which the position in relation to the frame is adjustable in said first direction.

5. Machine according to claim 1, wherein said bar is carried by said links and acts as said guide member.

6. Machine according to claim 5, wherein said bar coupling means comprise a series of pins regularly spaced along the bar and extending parallel to said first direction, and the bearing member comprises a tongue engageable between any pair of adjacent pins of the series.

7. Machine according to claim 5, wherein said bar coupling means comprise a series of holes regularly spaced along the bar and having their axes parallel to said first direction, and said bearing member comprises a tapered element engageable into one of said holes of the series.

8. Machine according to claim 5, wherein said bar coupling means comprise one portion of said bar which is made of magnetizable material, and the bearing member comprise a permanent magnet.

9. Machine according to claim 1, wherein said bar is rigidly connected to the movable carrier and acts as said bearing member.

10. Machine according to claim 2, wherein said predetermined angle is equal to 15°.

11. Machine according to claim 3, wherein length of said links is equal to 75 mm.

* * * * *